US011538616B2

(12) United States Patent
Kim et al.

(10) Patent No.: US 11,538,616 B2
(45) Date of Patent: Dec. 27, 2022

(54) COIL ELECTRONIC COMPONENT

(71) Applicant: SAMSUNG ELECTRO-MECHANICS CO., LTD., Suwon-si (KR)

(72) Inventors: Kyung Lock Kim, Suwon-si (KR); Byeong Cheol Moon, Suwon-si (KR); Chang Hak Choi, Suwon-si (KR); Jeong Gu Yeo, Suwon-si (KR); Young Il Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 631 days.

(21) Appl. No.: 16/399,534

(22) Filed: Apr. 30, 2019

(65) Prior Publication Data

US 2020/0066436 A1 Feb. 27, 2020

(30) Foreign Application Priority Data

Aug. 22, 2018 (KR) ..... 10-2018-0097772
Dec. 5, 2018 (KR) ..... 10-2018-0155329

(51) Int. Cl.
*H01F 27/255* (2006.01)
*H01F 27/28* (2006.01)
(Continued)

(52) U.S. Cl.
CPC ..... *H01F 27/255* (2013.01); *H01F 1/20* (2013.01); *H01F 27/2804* (2013.01);
(Continued)

(58) Field of Classification Search
CPC ..... H01F 17/0013; H01F 2027/2809; H01F 17/0006; H01F 27/2804; H01F 5/003;
(Continued)

(56) References Cited

U.S. PATENT DOCUMENTS 5,985,466 A * 11/1999 Atarashi ..... G03G 9/0834 428/570
2007/0235109 A1* 10/2007 Maeda ..... H01F 1/24 148/307

(Continued)

FOREIGN PATENT DOCUMENTS

JP 2002-170707 A 6/2002
JP 2003-272911 A 9/2003

(Continued)

OTHER PUBLICATIONS

Japanese Office Action dated Jan. 28, 2020 issued in Japanese Patent Application No. 2019-083406 (with English translation).

(Continued)

*Primary Examiner* — Tszfung J Chan
(74) *Attorney, Agent, or Firm* — Morgan, Lewis & Bockius LLP

(57) ABSTRACT

A coil electronic component includes a body, in which a coil portion is embedded, including a plurality of magnetic particles, and an external electrode connected to the coil portion. Among the plurality of magnetic particles, at least a portion of magnetic particles include a first layer, disposed on a surface of a magnetic particle among the magnetic particles, and a second layer disposed on a surface of the first layer. The first layer is an inorganic coating layer containing a phosphorus (P) component, and the second layer is an atomic layer deposition layer.

14 Claims, 3 Drawing Sheets

(51) Int. Cl.

| | |
|---|---|
| ***H01F 27/29*** | (2006.01) |
| ***H01F 41/04*** | (2006.01) |
| ***H01F 41/12*** | (2006.01) |
| ***H01F 27/32*** | (2006.01) |
| ***H01F 1/20*** | (2006.01) |

(52) U.S. Cl.
CPC ..... *H01F 27/29* (2013.01); *H01F 27/32* (2013.01); *H01F 41/041* (2013.01); *H01F 41/12* (2013.01); *H01F 2027/2809* (2013.01)

(58) Field of Classification Search
CPC . H01F 27/255; H01F 1/20; H01F 1/24; H01F 1/342; H01F 1/36; H01F 3/08; H01F 27/29; H01F 27/32; H01F 41/041; H01F 41/12
USPC ..... 336/200, 232, 233
See application file for complete search history.

(56) References Cited

U.S. PATENT DOCUMENTS

| | | | | |
|---|---|---|---|---|
| 2008/0044679 | A1* | 2/2008 | Maeda | H01F 1/26 428/546 |
| 2016/0043602 | A1* | 2/2016 | Hosek | H02K 1/02 310/208 |
| 2016/0125987 | A1* | 5/2016 | Moon | C22C 45/02 252/62.54 |
| 2016/0155550 | A1 | 6/2016 | Ohkubo et al. | |
| 2016/0314889 | A1* | 10/2016 | Ryu | H01F 41/0246 |
| 2017/0032880 | A1 | 2/2017 | Jeong | |
| 2017/0117082 | A1 | 4/2017 | Jeong | |
| 2018/0061550 | A1 | 3/2018 | Lee et al. | |
| 2019/0392978 | A1* | 12/2019 | Matsuura | H01F 27/02 |

FOREIGN PATENT DOCUMENTS

| | | | | |
|---|---|---|---|---|
| JP | 2003272911 | A | * 9/2003 | |
| JP | 2006-351946 | A | 12/2006 | |
| JP | 2007-088156 | A | 4/2007 | |
| JP | 2016-540111 | A | 12/2016 | |
| JP | 2017-017326 | A | 1/2017 | |
| KR | 10-2017-0014790 | A | 2/2017 | |
| KR | 10-1744627 | B1 | 5/2017 | |
| KR | 10-2017-0048724 | A | 6/2017 | |
| KR | 10-2018-0025068 | A | 3/2018 | |
| WO | 2015/048733 | A1 | 4/2015 | |
| WO | WO-2017018264 | A1 * | 2/2017 | B22F 1/00 |

OTHER PUBLICATIONS

Korean Office Action dated Dec. 13, 2019 issued in Korean Patent Application No. 10-2018-0155329 (with English translation).

* cited by examiner

COIL ELECTRONIC COMPONENT

CROSS-REFERENCE TO RELATED APPLICATION(S)

This application claims benefit of priority to Korean Patent Application Nos. 10-2018-0097772 filed on Aug. 22, 2018 and 10-2018-0155329 filed on Dec. 5, 2018 in the Korean Intellectual Property Office, the disclosures of which are incorporated herein by reference in their entirety.

BACKGROUND

The present disclosure relates to a coil electronic component.

In accordance with miniaturization and thinning of electronic devices such as a digital television (TV), a mobile phone, a laptop computer, and the like, miniaturization and thinning of coil electronic components used in such electronic devices have been demanded. In order to satisfy such a demand, research and development of various winding type or thin film type coil electronic components have been actively conducted.

A main issue depending on the miniaturization and the thinning of the coil electronic component is to implement characteristics equal to characteristics of an existing coil electronic component in spite of the miniaturization and the thinness. In order to satisfy such a demand, a ratio of a magnetic material should be increased in a core in which the magnetic material is filled. However, there is a limitation in increasing the ratio due to a change in strength of a body of an inductor, frequency characteristics depending on an insulation property of the body, and the like.

As an example of a method of manufacturing the coil electronic component, a method of implementing the body by stacking and then pressing sheets in which magnetic particles, a resin, and the like, are mixed with each other on coils has been used, and ferrite, a metal, or the like, may be used as the magnetic particles. When metal magnetic particles are used, it is advantageous in terms of characteristics such as a magnetic permeability, or the like, of the coil electronic component to increase a content of the metal magnetic particles. However, in this case, an insulation property of the body is deteriorated, such that breakdown voltage characteristics of the coil electronic component may be deteriorated.

SUMMARY

An aspect of the present disclosure is to provide a coil electronic component having breakdown voltage characteristics improved with improvements in insulating characteristics of conductive particles contained in a body. In such a coil electronic component, an insulation property of a body may be improved to improve magnetic characteristics and implement miniaturization.

According to an aspect of the present disclosure, a coil electronic component includes a body, in which a coil portion is embedded, including a plurality of magnetic particles, and an external electrode connected to the coil portion. Among the plurality of magnetic particles, at least a portion of magnetic particles include a first layer, disposed on a surface of a magnetic particle among the magnetic particles, and a second layer disposed on a surface of the first layer. The first layer is an inorganic coating layer containing a phosphorus (P) component, and the second layer is an atomic layer deposition layer.

The first layer may have a thickness of 10 to 15 nanometers.

The second layer may have a thickness of 10 to 15 nanometers.

A sum of thicknesses of the first and second layers may be 20 to 30 nanometers.

The first and second layers may be formed of different materials to each other.

The coil electronic component may further include a third layer disposed on a surface of the second layer.

The third layer may be formed of the same material as the first layer.

The third layer may be an inorganic coating layer containing a P component.

The second layer may include at least one of alumina ($Al_2O_3$) and silica ($SiO_2$).

The plurality of magnetic particles may include a plurality of first particles and a plurality of second particles, having sizes smaller than those of the first particles.

The first particle may be formed of an iron-based (Fe-based) alloy.

The first particle may have a diameter of 10 to 25 micrometers.

The second particle may be formed of pure iron.

The second particle may have a diameter of 5 micrometers or less.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, embodiments in the present disclosure will be described as follows with reference to the attached drawings.

Figure 1:
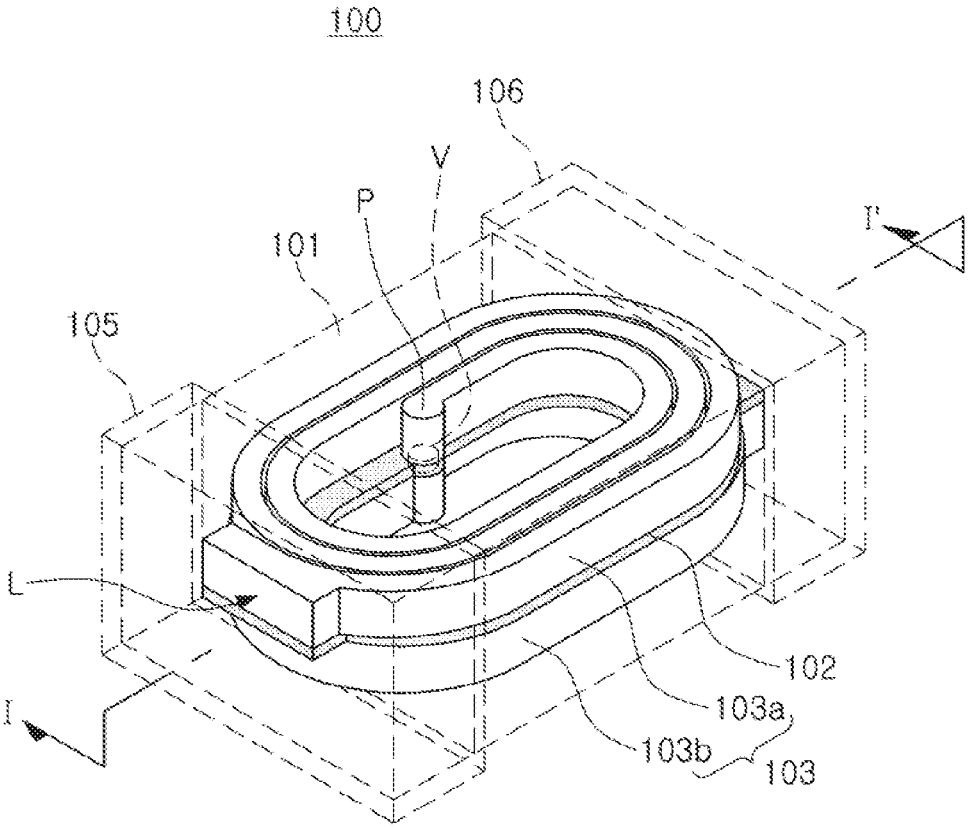
FIG. 1 is a perspective view of a coil electronic component according to an example embodiment in the present disclosure.
Figure 2:
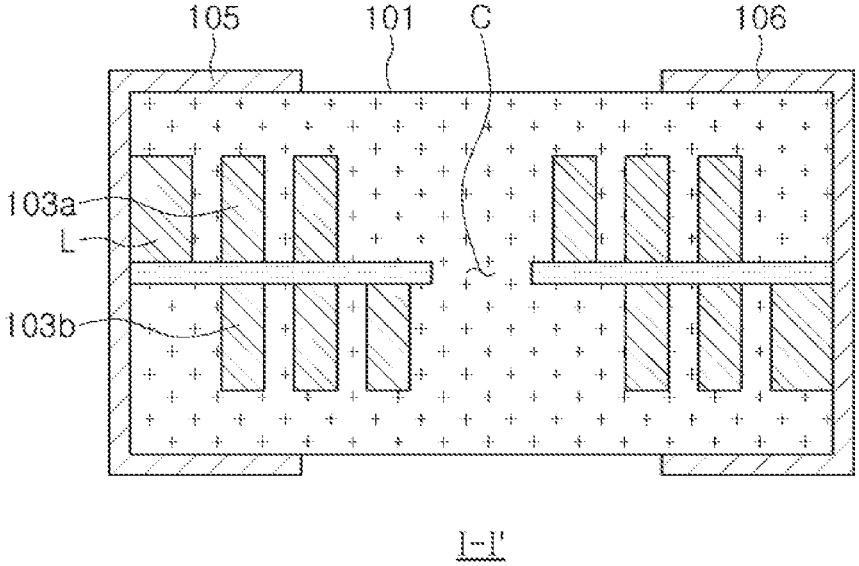
FIG. 2 is a cutaway cross-sectional view, taken along line I-I' in FIG. 1, illustrating the coil electronic component in FIG. 1.
Figure 4:
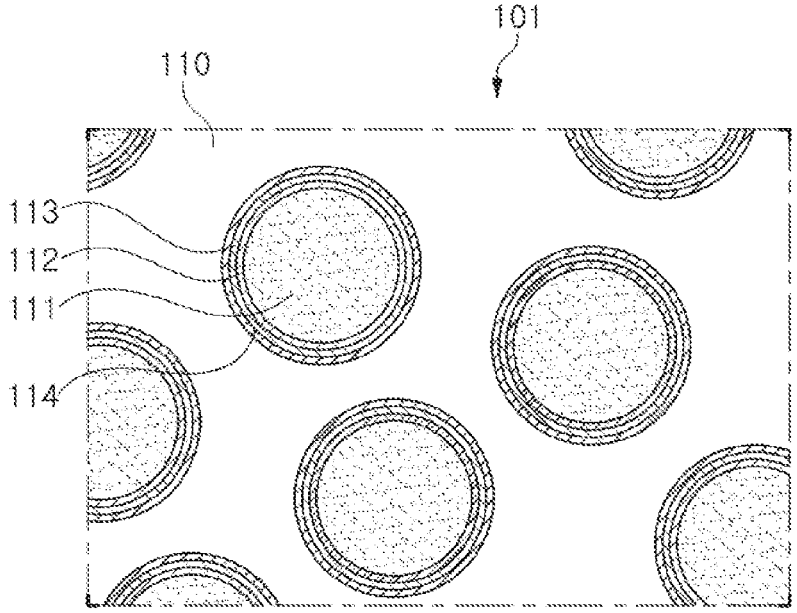
Figure 5:
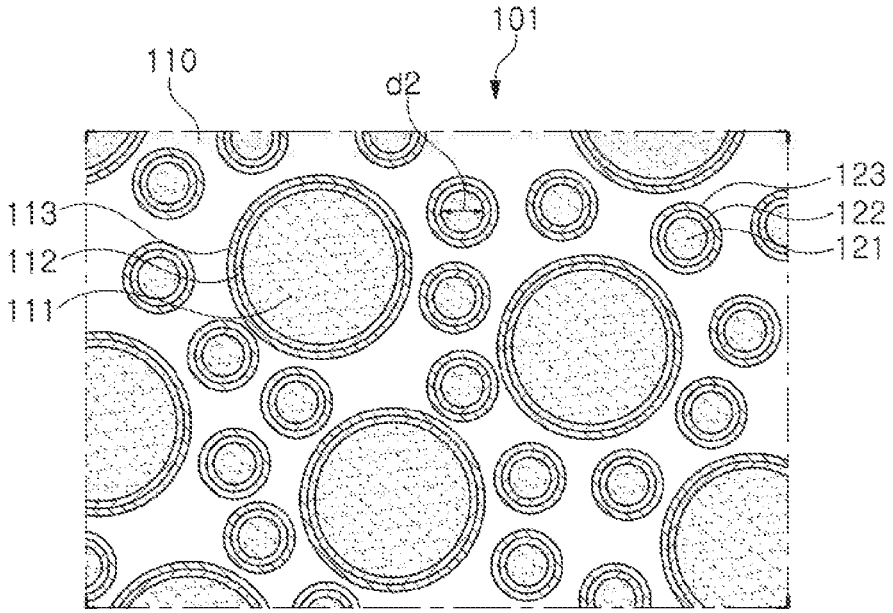

FIG. 1 is a perspective view of a coil electronic component according to an example embodiment in the present disclosure. FIG. 2 is a cutaway cross-sectional view, taken along line I-I' in FIG. 1, illustrating the coil electronic component in FIG. 1. Each of FIGS. 3 to 5 is an enlarged view of one region of a body in the coil electronic component in FIG. 1.

Figure 3:
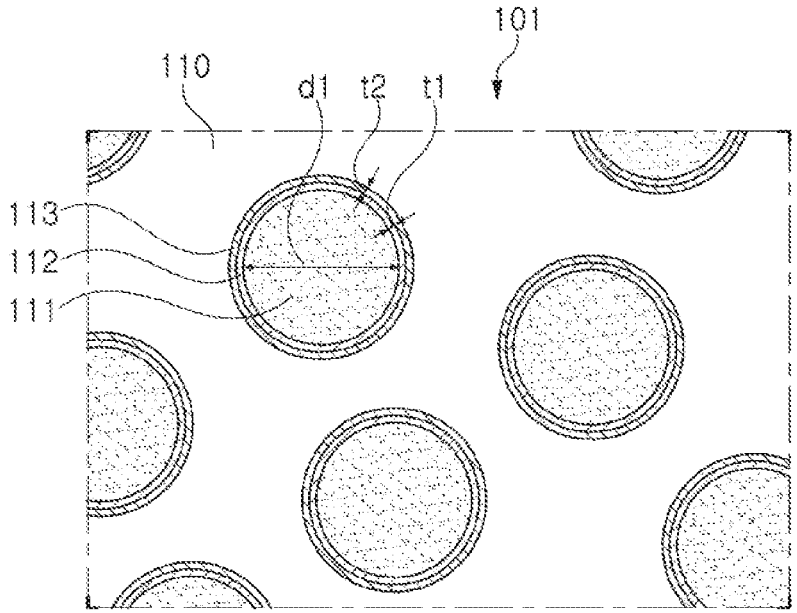
FIG. 3 is an enlarged view of one region of a body in the coil electronic component in FIG. 1; and Each of FIGS. 4 and 5 is an enlarged view of one region of a body of a coil electronic component according to a modified embodiment in the present disclosure.

Referring to FIGS. 1 to 3, a coil electronic component 100 according an example embodiment includes a body 101, a support substrate 102, a coil pattern 103, and external electrodes 15 and 106. The body 101 includes a plurality of magnetic particles 111. Among the plurality of magnetic particles 111, at least a portion of magnetic particles include a first layer 112 and a second layer 113. The first layer 112 is an inorganic coating layer, including phosphorus (P) components, and the second layer 113 is an atomic layer deposition layer.

The body 101 may encapsulate at least portions of the support substrate 102 and the coil pattern 103, and may form an exterior of the coil electronic component 100. The body 101 may be disposed in such a manner that a portion of a lead-out pattern L is exposed outwardly of the body 101. As illustrated in FIG. 3, the body 101 may include a plurality of magnetic particles 111, and the plurality of magnetic particles may be dispersed in an insulating material 110. The insulating material 110 may include a polymer such as an epoxy resin, polyimide, or the like.

As the magnetic particle 111 that may be included in the body 101, ferrite, a metal, or the like may be used. In the case of the metal, the magnetic particle 111 may include an iron-based (Fe-based) alloy or the like. More specifically, the magnetic particle 111 may be formed of a nanocrystalline grain boundary alloy having a composition of iron-silicon-boron-chromium (Fe—Si—B—Cr), an iron-nickel (Fe—Ni) based alloy, or the like. Each of the plurality of magnetic particles 111 may have a diameter d1 of 10 to 25 micrometers (μm). As described above, when the magnetic particle 111 is formed of a Fe-based alloy, the magnetic particle 111 may be vulnerable to electrostatic discharge (ESD) while having improved magnetic characteristics such as permeability and the like. Therefore, in the present embodiment, insulating layers 112 and 113 having a multilayer structure are formed on a surface of the magnetic particle 111. More specifically, among the plurality of magnetic particles 111, at least a portion of magnetic particles include a first layer 112, disposed on a surface thereof, and a second layer 113 disposed on a surface of the first layer 112.

The first layer 112 is an inorganic coating layer containing a phosphorus (P) component. For example, the first layer 112 may be a P-based glass. A P-based inorganic coating layer, included in the first layer 112, may include components such as phosphorus (P), zinc (Zn), silicon (Si), and the like, and may include an oxide of the above-mentioned components. In the case of the first layer 112, a P-based inorganic coating layer, the magnetic particle 111 may stably coated to be effectively insulated, but a thickness of the first layer 112 is not uniform. As the thickness of the first layer 112 is increased, the non-uniformity of the thickness of the first layer 112 is increased. In the present embodiment, the first layer 112 may be formed to have a relatively small thickness, and a thickness t1 thereof may be 10 to 15 nanometers (nm). The magnetic particle 111 has an insulating structure in which the first layer 112 is formed to have a small thickness and the second layer 113, having improved insulation property and uniformity, is disposed on the first layer 112.

The second layer 113 is an atomic layer deposition (ALD) layer. Accordingly, a multilayer insulating structure may be prevented from increasing in thickness while enhancing the insulating property of the magnetic particles 111. The atomic layer deposition is a process in which a surface of a target object may be significantly uniformly coated at an atomic layer level by a surface chemical reaction during periodic supply and discharge of reactants. The second layer 113, obtained through the atomic layer deposition, has an improved insulation property while having a small and uniform thickness. Accordingly, even when a large amount of magnetic particles 111 fill the body 101, the insulation property of the body 101 may be effectively secured. It may be difficult to additionally coat a P-based inorganic coating layer on the first layer 112, a P-based inorganic coating layer. In the case in which the second layer 113 is an atomic layer deposition layer set forth in the present embodiment, an additional coating layer may be easily formed. The second layer 113 may be formed of a material different from a material of the first layer 112, and may be formed of, for example, ceramic. More specifically, the second layer 113 may include alumina ($Al_2O_3$), silica ($SiO_2$), or the like. However, the second layer 113 may be formed of various materials, which may be formed by atomic layer deposition, in addition to the above-mentioned materials. As a detailed example, the second layer 113 may include a material such as $TiO_2$, $ZnO_2$, $HfO_2$, $Ta_2O_5$, $Nb_2O_5$, $Sc_2O_3$, $Y_2O_3$, MgO, $B_2O_3$, $GeO_2$, or the like. In addition, the second layer 113 is formed to have a relatively small thickness, which is advantageous in miniaturizing the body 101. The second layer may have a thickness t2 of 10 to 15 nm.

As described above, each of the first layer 112 and the second layer 113 may have a thickness of 10 to 15 nm, and the sum of the thicknesses of the first layer 112 and the second layer 113 (t1+t2) may be 20 to 30 nm. In a related art invention, an insulating layer of a magnetic particle 111 has a thickness of about 60 nm. In the present embodiment, the multilayer insulating structure (112 and 113) may have a thickness of 20 to 30 nm, which is half the thickness of the insulating layer of the related art. Thus, a volume, occupied by the magnetic particles 111, may be increased. Since the amount of the magnetic particles 111 in the body 101 may be increased, permeability of the coil electronic component 100 may be improved as compared to an insulating structure according to a related art. Moreover, the second layer 113, which is in the form of an atomic layer deposition layer, may be formed on the first layer 112, a P-based inorganic coating layer, to have a small thickness, and thus, improved insulation property may be obtained even at a small thickness. As the insulation of the magnetic particles 111 is improved, breakdown voltage (BDV) characteristic of the coil electronic component 100 may be improved.

In regard to an example of the manufacturing method, the body 101 may be formed by a lamination method. More specifically, after a coil portion 103 is formed on the support substrate 102 by a plating process or the like, a plurality of unit laminates for manufacturing the body 101 are prepared and laminated. The unit laminate is prepared by mixing a magnetic particle 111 such as a metal with an organic material such as a thermosetting resin, a binder, a solvent, or the like to prepare slurry. The slurry is coated on a carrier film by a doctor blade method to have a thickness of several micrometers (μm), and then dried to form a sheet. Accordingly, the unit laminate may be manufactured in such a manner that the magnetic particles are dispersed in a thermosetting resin such as an epoxy resin or polyimide. The magnetic particle 111 may have the above-described shape and may have a surface on which the first layer 112 and the second layer 113 are coated. After the plurality of unit laminates may be formed, they may be pressed and laminated above and below the coil portion 103 to implement the body 101.

The support substrate 102 may support the coil portion 103, and may be a polypropylene glycol (PPG) substrate, a ferrite substrate, a metal-based soft magnetic substrate, or the like. As illustrated in the drawings, the support substrate 102 has a central portion through which a through-hole is formed to penetrate, and the body 101 fills the through-hole to form a magnetic core portion C.

The coil portion 103 is embedded in the body 101 and serves to perform various functions in an electronic device through characteristics revealed from a coil of the coil electronic component 100. For example, the coiled electronic component 100 may be a power inductor. In this case, the coil portion 103 may store electric power in the form of a magnetic field to maintain an output voltage and stabilize power. A coil pattern, constituting the coil portion 103, may be respectively laminated on both sides of the support substrate 102, and may be electrically connected to each other through a conductive via V penetrating through the support substrate 102. The coil portion 103 may be formed in a spiral shape. An outermost portion of the spiral shape may be provided with a lead-out portion T, exposed outwardly of the body 101, to be electrically connected to external electrodes 105 and 106.

The coil portion 103 is disposed on at least one of a first surface (an upper surface based on FIG. 2) and a second surface (a lower surface based on FIG. 2) disposed to oppose each other on the support substrate 102. As in the present embodiment, the coil portion 103 may be disposed on both the first and second surfaces of the support substrate 102. In this case, the coil portion 103 may include a pad region P. Alternatively, the coil portion 103 may be disposed on only one surface of the support substrate 102. The coil pattern, constituting the coil portion 103, may be formed by a plating process, known in the art, such as a pattern plating process, an anisotropic plating process, an isotropic plating process, or the like. The coil portion 103 may be formed to have a multilayer structure using a plurality of processes among the above processes.

The external electrodes 105 and 106 may be formed on outside of the body 101 to be connected to the lead-out portion T. The external electrodes 105 and 106 may be formed using a paste containing a metal having improved electrical conductivity, and may be a conductive paste containing nickel (Ni), copper (Cu), tin (Sn), silver (Ag), or alloys thereof. A plating layer, not illustrated, may be further formed on the external electrodes 105 and 106. In this case, the plating layer may include at least one selected from the group consisting of nickel (Ni), copper (Cu), and tin (Sn). For example, a nickel (Ni) layer and a tin (Sn) layer may be sequentially formed.

Hereinafter, a body structure of a coil electronic component, which may be employed in modified examples, will be described with reference to FIGS. 4 and 5. In the case of an embodiment of FIG. 4, a three-layer insulating structure may be disposed on a surface of a magnetic particle 111. More specifically, the magnetic particle 111 may have a shape further including a third layer 114, disposed on a surface of the second layer 113, and may be employed to further improve the insulating properties of the magnetic particle 111. The third layer 114 may be formed of the same material as the first layer 112, in detail, an inorganic coating layer containing a phosphorus (P) component. The third layer 114 may also have a thickness similar to the thickness of the first layer 112, for example, 10 to 15 nm. In the case in which an additional insulating structure is required as in the embodiment of FIG. 4, a third layer 114, covering the second layer 113, may be employed and a fourth layer may be further disposed on the third layer 114. For example, the insulating structure of the magnetic particles 111 may have a multilayer structure of a P-based inorganic coating layer/an atomic layer deposition layer/a P-based inorganic coating layer/an atomic layer deposition layer.

In case of an embodiment of FIG. 5, particles, having different grain size distributions, are disposed in a body 101. More specifically, a plurality of magnetic particles include a plurality of first particles 111 and a plurality of second particles 121, having sizes smaller than those of the second particles 121. In this case, the first particles 111 are the same as the particles 111, described in the embodiment of FIG. 3, and may be formed of a Fe-based alloy. The second particles 121 may include a first layer 122 and a second layer 123. The second particle 121, having a thickness smaller than a thickness of the first particle 111, may fill a space between the first particles 111 to increase the entire amount of the magnetic particles 111 and 121 present in the body 101. The second particles 121 may be formed of pure iron, for example, in the form of carbonyl iron powder (CIP). In addition, the second particles 121 may have a diameter d2 of 5 μm or less.

As described above, in the case of a coil electronic component according to an example embodiment, breakdown voltage characteristics may be improved with improvements in insulation properties of a body. Moreover, a thin coating layer may be employed on a surface of a magnetic particle to be appropriate for miniaturization.

While example embodiments have been illustrated and described above, it will be apparent to those skilled in the art that modifications and variations could be made without departing from the scope of the present disclosure as defined by the appended claims.

What is claimed is:

1. A coil electronic component comprising:

a body, in which a coil portion is embedded, including a plurality of magnetic particles;

an external electrode connected to the coil portion, wherein among the plurality of magnetic particles, at least a portion of magnetic particles include a first layer, disposed on a surface of a magnetic particle among the magnetic particles, a second layer disposed on a surface of the first layer, and a third layer disposed on a surface of the second layer, the first and third layers are inorganic coating layers containing a phosphorus (P) component, and the second layer includes an oxide having at least one of Al, Si, Ti, Zn, Hf, Ta, Nb, Sc, Y, Mg, B, or Ge.

2. The coil electronic component of claim 1, wherein the first layer has a thickness of 10 to 15 nanometers.

3. The coil electronic component of claim 1, wherein the second layer has a thickness of 10 to 15 nanometers.

4. The coil electronic component of claim 1, wherein a sum of thicknesses of the first and second layers is 20 to 30 nanometers.

5. The coil electronic component of claim 1, wherein the first and second layers are formed of different materials to each other.

6. The coil electronic component of claim 1, wherein the third layer is formed of a same material as the first layer.

7. The coil electronic component of claim 1, wherein the plurality of magnetic particles include a plurality of first particles and a plurality of second particles having sizes smaller than those of the first particles.

8. The coil electronic component of claim 7, wherein the first particle is formed of an iron-based (Fe-based) alloy.

9. The coil electronic component of claim 7, wherein the first particle has a diameter of 10 to 25 micrometers.

10. The coil electronic component of claim 7, wherein the second particle is formed of pure iron.

11. The coil electronic component of claim 7, wherein the second particle has a diameter of 5 micrometers or less.

12. The coil electronic component of claim 1, wherein the second layer is an atomic layer deposition layer.

13. The coil electronic component of claim 1, wherein the second layer includes a ceramic.

14. The coil electronic component of claim 1, wherein the second layer does not contain the phosphorus (P) component.

* * * * *